US010141631B2

(12) United States Patent
Merli et al.

(10) Patent No.: US 10,141,631 B2
(45) Date of Patent: Nov. 27, 2018

(54) ELECTRONIC DEVICE WITH ANTENNA

(71) Applicant: Apple Inc., Cupertino, CA (US)

(72) Inventors: Francesco Merli, Campbell, CA (US); Yi Jiang, Sunnyvale, CA (US); Boon W. Shiu, San Jose, CA (US); Carlo Di Nallo, San Carlos, CA (US); Javier Gomez Tagle, Cupertino, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 251 days.

(21) Appl. No.: 14/966,446

(22) Filed: Dec. 11, 2015

(65) Prior Publication Data

US 2017/0170545 A1 Jun. 15, 2017

(51) Int. Cl.

| | |
|---|---|
| ***H01Q 1/22*** | (2006.01) |
| ***H01Q 9/04*** | (2006.01) |
| ***H04R 1/02*** | (2006.01) |
| ***H01Q 1/24*** | (2006.01) |
| ***H01Q 1/44*** | (2006.01) |
| ***H01Q 9/42*** | (2006.01) |

(52) U.S. Cl.

CPC ..... *H01Q 1/2291* (2013.01); *H01Q 1/243* (2013.01); *H01Q 1/44* (2013.01); *H01Q 9/0421* (2013.01); *H01Q 9/0457* (2013.01); *H01Q 9/42* (2013.01); *H04R 1/02* (2013.01)

(58) Field of Classification Search

CPC .. H01Q 1/2291; H01Q 9/0421; H01Q 9/0457; H01Q 1/243; H01Q 1/44; H01Q 9/42; H04R 1/02

See application file for complete search history.

(56) References Cited

U.S. PATENT DOCUMENTS

| | | | |
|---|---|---|---|
| 8,754,817 | B1 | 6/2014 | Kuo et al. |
| 8,896,488 | B2 | 11/2014 | Ayala Vazquez et al. |

(Continued)

FOREIGN PATENT DOCUMENTS

| | | | |
|---|---|---|---|
| CN | 1430466 | A | 7/2003 |
| CN | 1518158 | A | 8/2004 |

(Continued)

*Primary Examiner* — Jessica Han

*Assistant Examiner* — Michael Bouizza

(74) *Attorney, Agent, or Firm* — Treyz Law Group, P.C.; G. Victor Treyz; Joseph F. Guihan

(57) ABSTRACT

An electronic device may be provided with wireless circuitry. The wireless circuitry may include an antenna. The electronic device may have a housing in which control circuitry and radio-frequency transceiver circuitry is mounted. The transceiver circuitry may be used to transmit and receive radio-frequency signals with the antenna. The housing may have a housing wall with a locally thinned portion aligned with the antenna. The antenna may have a sheet metal layer attached to a plastic cavity with a layer of adhesive. Recesses in a printed circuit may receive prongs formed from a sheet metal layer. The plastic carrier may have cavities separated by ribs. The sheet metal layer may form a planar inverted-F antenna resonating element, a ground plane, a return path between the resonating element and ground plane, and a feed path that extends along one of the ribs and into an opening in the printed circuit.

20 Claims, 10 Drawing Sheets

(56) References Cited

U.S. PATENT DOCUMENTS

| | | | | |
|---|---|---|---|---|
| 2003/0107881 | A1* | 6/2003 | Muramatsu | H01Q 9/0421 361/818 |
| 2007/0008221 | A1* | 1/2007 | Tseng | H01Q 9/42 343/700 MS |
| 2010/0127938 | A1 | 5/2010 | Ali et al. | |
| 2012/0223866 | A1* | 9/2012 | Ayala Vazquez | H01Q 1/243 343/702 |
| 2013/0016870 | A1* | 1/2013 | Chen | H01Q 1/2291 381/391 |
| 2014/0100004 | A1* | 4/2014 | Yarga | H01Q 1/243 455/575.8 |
| 2014/0132463 | A1* | 5/2014 | Hobson | H01Q 1/243 343/702 |
| 2014/0306845 | A1* | 10/2014 | Shiu | H01Q 9/0421 343/700 MS |

FOREIGN PATENT DOCUMENTS

| | | | |
|---|---|---|---|
| CN | 1856904 | A | 11/2006 |
| CN | 201298961 | Y | 8/2009 |
| CN | 101778531 | A | 7/2010 |
| CN | 203775348 | U | 8/2014 |
| CN | 204243208 | U | 4/2015 |
| CN | 204407467 | U | 6/2015 |
| WO | 2011018551 | | 2/2011 |

* cited by examiner

ELECTRONIC DEVICE WITH ANTENNA

BACKGROUND

This relates generally to electronic devices and, more particularly, to electronic devices with wireless communications circuitry.

Electronic devices often include wireless communications circuitry. For example, cellular telephones, computers, wireless speakers, and other devices often contain antennas and wireless transceivers for supporting wireless communications.

It can be challenging to form electronic device antenna structures with desired attributes. In some wireless devices, structures such as housing walls can interfere with antenna operation. Some antenna designs may not be sufficiently robust to withstand vibrations produced during device operation. Challenges with ensuring satisfactory antenna alignment, ease of manufacturing, and desired antenna performance can also impact the effectiveness of an antenna design.

It would therefore be desirable to be able to provide improved wireless circuitry for electronic devices such as improved antennas for electronic devices.

SUMMARY

An electronic device may be provided with wireless circuitry. The wireless circuitry may include an antenna and radio-frequency transceiver circuitry. The electronic device may have a housing in which the wireless circuitry is mounted. The transceiver circuitry may be used to transmit and receive radio-frequency signals using the antenna.

The housing may have a dielectric housing wall with a locally thinned portion aligned with the antenna. The antenna may be used to transmit and receive signals through the locally thinned portion.

The antenna may have a sheet metal layer attached to a plastic cavity with a layer of adhesive. Recesses in a printed circuit may receive prongs formed from the sheet metal layer.

The plastic carrier may have cavities separated by ribs. The sheet metal layer may form a planar inverted-F antenna resonating element, a ground plane, a return path extending between the resonating element and ground plane, and a feed path that extends along one of the ribs from the resonating element into an opening in the printed circuit.

The electronic device may include speakers mounted behind metal speaker grills. An antenna feed for the antenna may be formed on a side of the antenna that faces inwardly away from an adjacent speaker grill.

DETAILED DESCRIPTION

Wireless electronic devices may be provided with one or more antennas. A wireless electronic device with an antenna may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless speaker with our without an embedded computer, equipment that implements the functionality of two or more of these devices, or other electronic equipment. In the illustrative configuration of FIG. 1, electronic device 10 is a wireless speaker. Other configurations may be used for device 10 if desired. The example of FIG. 1 is merely illustrative.

Figure 1:
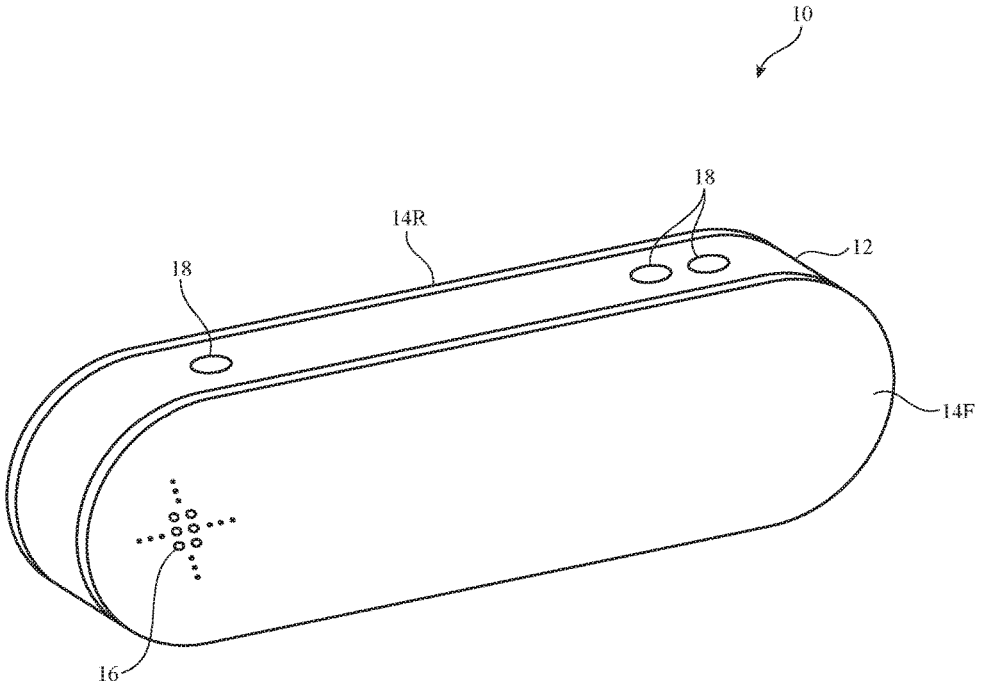
FIG. 1 is a perspective view of an illustrative electronic device with wireless communications circuitry in accordance with an embodiment.

As shown in FIG. 1, device 10 may have a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). Housing 12 may have openings to accommodate connector ports, windows for light-based components, buttons such as buttons 18, and other components.

Electrical components may be mounted in housing 12. These components may include a battery, integrated circuits, speakers, and other electrical components. To allow sound from speakers in housing 12 to pass to the exterior of device 10, device 10 may include housing wall structures such as front speaker grill 14F and rear speaker grill 14R. Speaker grills 14R and 14F may be formed form metal, plastic, or other suitable materials. An array of openings 16 may be formed on each speaker grill to allow sound to pass through the speaker grill.

An antenna for device 10 may be mounted under the upper surface of housing 12 (e.g., under a dielectric housing wall or a dielectric portion of a housing wall that serves as an antenna window in a metal housing wall) or may be mounted elsewhere within device 10. In some configurations, device 10 may have multiple antennas. Arrangements in which device 10 includes a single antenna may sometimes be described herein as an example. The antenna in device 10 may be used to receive wirelessly streamed music or other audio that is played for a user through the speakers of device 10 or may handle other wireless communications for device 10.

Figure 2:
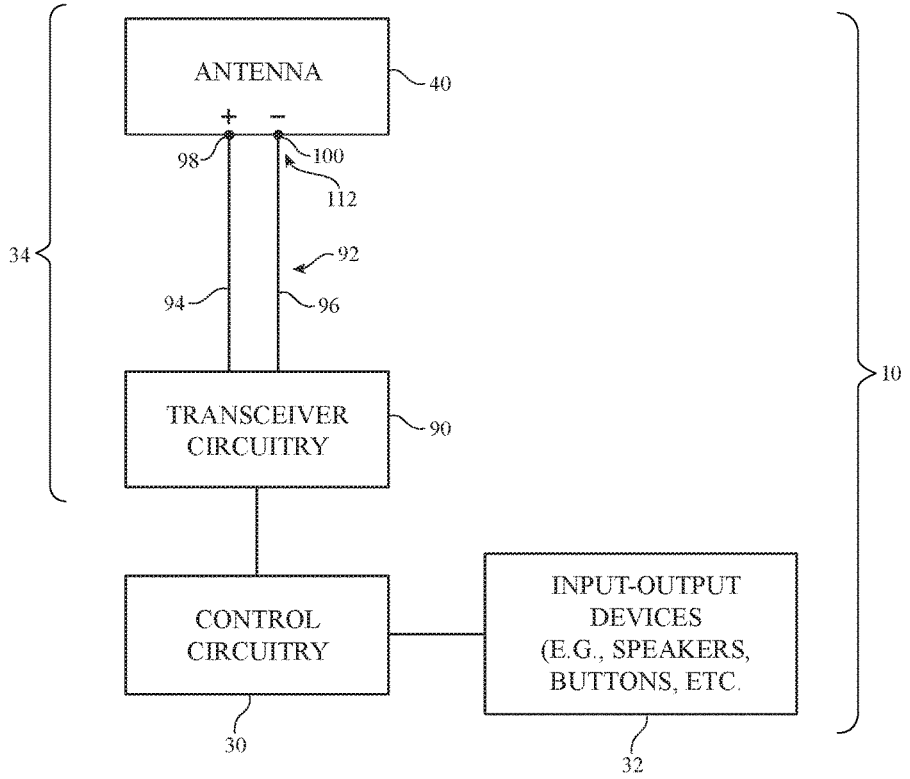
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include storage and processing circuitry such as control circuitry 30. Circuitry 30 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in circuitry 30 may be used to control the operation of device 10. This processing circuitry may be based on one or more microprocessors, microcontrollers, digital signal processors, baseband processor integrated circuits, application specific integrated circuits, etc.

Circuitry 30 may be used to run software on device 10, such as internet browsing applications, voice-over-internet-protocol (VOIP) telephone call applications, email applications, media playback applications, operating system functions, etc. To support interactions with external equipment, circuitry 30 may be used in implementing communications protocols. Communications protocols that may be implemented using circuitry 30 include wireless local area network protocols (e.g., IEEE 802.11 protocols—sometimes referred to as WiFi®), protocols for other short-range wireless communications links such as the Bluetooth® protocol, and other wireless communications protocols.

Device 10 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers, proximity sensors, and other sensors and input-output components.

Device 10 may include wireless communications circuitry 34 that allows control circuitry 30 of device 10 to communicate wirelessly with external equipment. The external equipment with which device 10 communicates wirelessly may be a computer, a cellular telephone, a watch, a router, a wireless base station, a display, or other electronic equipment. Wireless communications circuitry 34 may include radio-frequency (RF) transceiver circuitry 90 and one or more antennas such as antenna 40. Configurations in which device 10 contains a single antenna may sometimes be described herein as an example.

Radio-frequency transceiver circuitry 90 and antenna 40 may be used to handle one or more radio-frequency communications bands. For example, circuitry 90 may include wireless local area network transceiver circuitry that may handle a 2.4 GHz band for WiFi® and/or Bluetooth® communications and, if desired, may include 5 GHz transceiver circuitry (e.g., for WiFi®). If desired, circuitry 90 and antenna 40 may handle communications in other bands (e.g., cellular telephone bands, near field communications bands, bands at millimeter wave frequencies, etc.).

Antenna 40 in wireless communications circuitry 34 may be formed using any suitable type of antenna. For example, antenna 40 may be an antenna with a resonating element that is formed from a loop antenna structure, a patch antenna structure, an inverted-F antenna structure, a slot antenna structure, a planar inverted-F antenna structure, a helical antenna structure, a hybrid of these structures, etc. If desired, antenna 40 may be a cavity-backed antenna. Circuitry 30, input-output devices 32, wireless circuitry 34, and other components of device 10 may be mounted in device housing 12.

As shown in FIG. 2, transceiver circuitry 90 in wireless circuitry 34 may be coupled to antenna 40 using paths such as transmission line path 92. Transmission line paths in device 10 such as transmission line 92 may include coaxial cable paths, microstrip transmission lines, stripline transmission lines, edge-coupled microstrip transmission lines, edge-coupled stripline transmission lines, transmission lines formed from combinations of transmission lines of these types, etc. Transmission line 92 may be coupled to antenna feed 112 for antenna 40. Antenna 40 may, for example, form a planar inverted-F antenna, a slot antenna, a hybrid inverted-F slot antenna or other antenna having an antenna feed such as feed 112 with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 100. Other types of antenna feed arrangements may be used if desired. The illustrative feeding configuration of FIG. 2 is merely illustrative.

Filter circuitry, switching circuitry, impedance matching circuitry, and other circuitry may be interposed within transmission line 92 or other portions of wireless circuitry 34, if desired. Control circuitry 30 may be coupled to transceiver circuitry 90 and input-output devices 32. During operation, input-output devices 32 may supply output from device 10 and may receive input from sources that are external to device 10. Control circuitry 30 may use wireless circuitry 34 to transmit and receive wireless signals. As an example, circuitry 30 may use wireless circuitry 34 to receive wireless audio information and may use or more speakers in devices 32 to play corresponding audio for a user of device 10.

Figure 3:
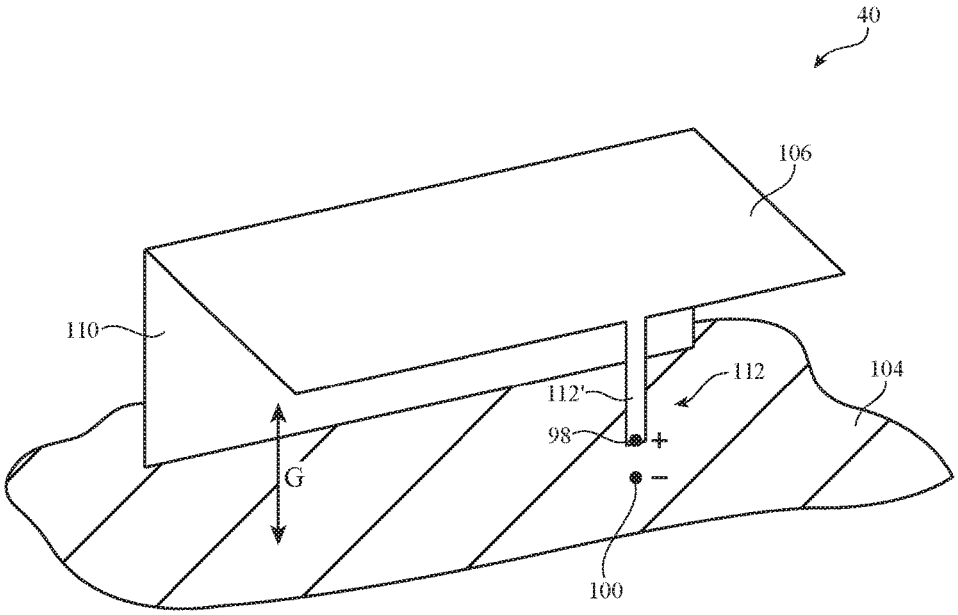
FIG. 3 is a perspective view of an illustrative planar inverted-F antenna in accordance with an embodiment.

FIG. 3 is a perspective view of an illustrative antenna for device 10. In the example of FIG. 3, antenna 40 is a planar inverted-F antenna having a planar inverted-F antenna resonating element 106 that is separated by vertical gap G from parallel ground plane 104. If desired, antenna resonating element 106 may have a meandering shape, a shape with multiple branches, or other suitable planar shape that lies parallel to ground 104. Return path 110 may have a planar shape that lies in a vertical plane or may be formed from other metal structures that couple resonating element 106 to ground plane 104. Feed path 112' may be formed from a narrow metal strip that extends from resonating element 106 to antenna feed terminal 98 in parallel with return path 110. Antenna feed 112 may be formed from antenna feed terminals 98 and 100. Antenna feed terminal 100 may be coupled to antenna ground 104. Ground 104 may be formed from a planar layer of metal or other suitable ground structures. Portions of ground 104 may be formed from ground traces in a printed circuit.

Figure 4:
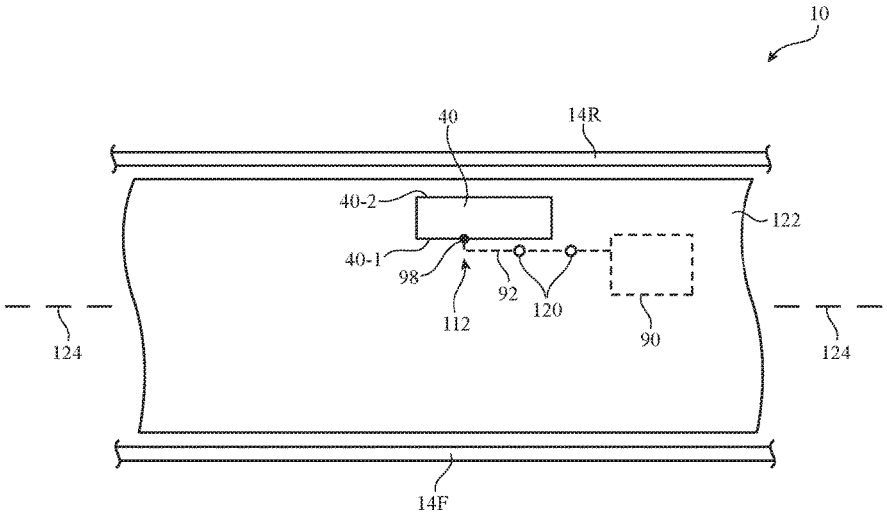
FIG. 4 is a cross-sectional top view of a portion of the electronic device of FIG. 1 showing an illustrative antenna feed arrangement for an antenna in accordance with an embodiment.

A cross-sectional top view of a portion of device 10 of FIG. 1 is shown in FIG. 4. As shown in FIG. 4, Antenna 40 may be mounted on a substrate such as printed circuit 122. Printed circuit 122 may be a rigid printed circuit board or may be a flexible printed circuit. With one illustrative configuration, printed circuit 122 may have an elongated rectangular shape that runs along the length of device 10 parallel to longitudinal axis 124 of device 10 and that extends laterally between rear grill (housing wall) 14R and front grill (housing wall) 14F.

Metal traces in printed circuit 122 may be used to form transmission line 92 and may couple transceiver circuitry 90 to antenna feed 112 of antenna 40. Antenna 40 may be mounted to the upper surface of printed circuit 112 under an upper wall of housing 12 and may transmit and receive wireless signals through the upper wall of housing 12. Transceiver circuitry 90 may be mounted on an opposing lower surface of printed circuit 112 (e.g., above a set of speakers and other electrical components in device 10). If desired, radio-frequency impedance matching circuit components and other electrical components 120 may be coupled to metal traces in printed circuit 122 (e.g., components 120 may be coupled within transmission line 92, etc.).

Antenna 40 may have an elongated shape (e.g., a shape with rectangular footprint that extends along a longitudinal axis parallel to axis 124) or other suitable shape. Antenna 40 may, for example, have a shape with first and second opposing vertical sides, one of which faces rear grill 14R and one of which faces in the opposite direction (i.e., inwardly and away from rear grill 14R). Antenna 40 may be a planar inverted-F antenna of the type shown in FIG. 3. Electromagnetic signals associated with the operation of this type of antenna may be more concentrated on the side of the antenna that includes antenna feed 112 than on the opposing side of the antenna. To minimize disruption to the operation of antenna 40 that might arise from placing antenna feed 112 too close to metal structures in device 10 such as rear grill 14R, it may be desirable to feed antenna 40 from the inner side of antenna 40 (i.e., between longitudinal axis 124 and the speaker grill adjacent to antenna 40). As shown in FIG. 4, for example, feed 112 may be located on inward side 40-1 of antenna 40 (which faces inwardly towards the longitudinal axis 124 of device 10 that is bisecting printed circuit 122) rather than on outward side 40-2 of antenna 40 (which faces outwardly away from axis 124 and towards adjacent metal grill 14R). Other configurations may be used for ensuring that antenna 40 operates satisfactorily in the vicinity of metal structures in device 10. The arrangement of FIG. 4 in which antenna feed 112 is on the inwardly facing side of antenna 40 rather than the outwardly facing side of antenna 40 is merely illustrative.

Figure 5:
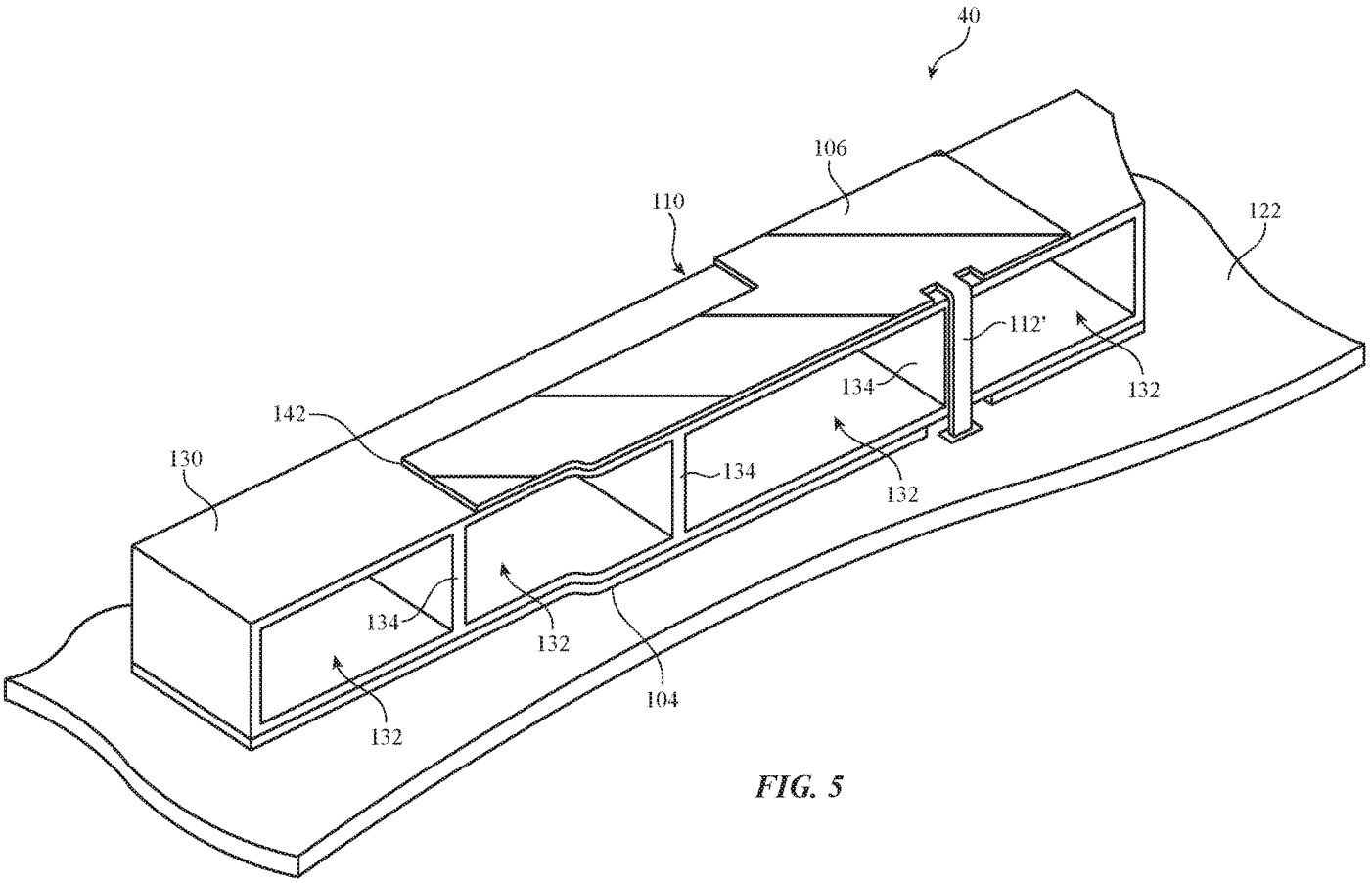
FIG. 5 is a perspective view of an illustrative planar inverted-F antenna mounted on a dielectric carrier on a printed circuit in accordance with an embodiment.

Antenna 40 may be formed from metal or other conductive material and may be supported using a dielectric support structure. Examples of metal structures that may be used in forming antenna 40 include metal housing wall structures, metal traces on printed circuits and other substrates, metal foil, wires, internal metal structures (e.g., brackets, etc.), or other suitable conductive structures in device 10. In the illustrative configuration of FIG. 5, antenna 40 has been formed from a patterned layer of metal (metal layer 142) that extends around a hollow dielectric carrier (carrier 130).

Metal layer 142 may be formed from a patterned sheet of metal such as a layer of nickel-plated stainless steel sheet metal. The thickness of layer 142 may be 0.05 to 0.5 mm, may be 0.05 to 0.3 mm, may be 0.1 to 0.3 mm, may be less than 0.4 mm, may be less than 1 mm, may be more than 0.1 mm, or may be any other suitable thickness. Hollow dielectric carrier 130 may have openings such as cavity openings 132 that provide the body of carrier 130 with a substantially hollow (air-filled) configuration. Support structures such as ribs 134 may extend across the gap formed between the upper wall of carrier 130 and the opposing lower wall of carrier 130. Ribs 134 may be formed at different respective locations along the length of carrier 130. The presence of air-filled openings in carrier 130 such as cavities 132 may help reduce dielectric losses when operating antenna 40. The inclusion of ribs 134 may help prevent the walls of carrier 130 from vibrating when sound is being played by the speakers within housing 12.

Metal 142 may be formed around carrier 130 and may be patterned to form antenna resonating element 106 (on the upper surface of carrier 130), return path 110 (on the rear surface of carrier 130), and ground plane 104 (on the bottom of carrier 130). A bent prong of protruding metal 142 may be used to form feed path 112'. With one suitable arrangement, metal 142 may be patterned and bent into a desired antenna structure before carrier 130 is inserted into the antenna structure to form antenna 40. Antenna 40 may then be mounted to printed circuit board 122 using solder or other conductive material. Other arrangements such as arrangements in which a sheet of metal 142 is patterned before or after wrapping metal 142 around carrier 130, arrangements in which metal traces are formed on carrier 130 using laser direct structuring, molded interconnect device schemes based on selective electroplating of metal onto a plastic carrier structure formed from multiple shots of plastic, and arrangements in which a flexible printed circuit with antenna traces is attached to a carrier may also be used, if desired.

Figure 6:
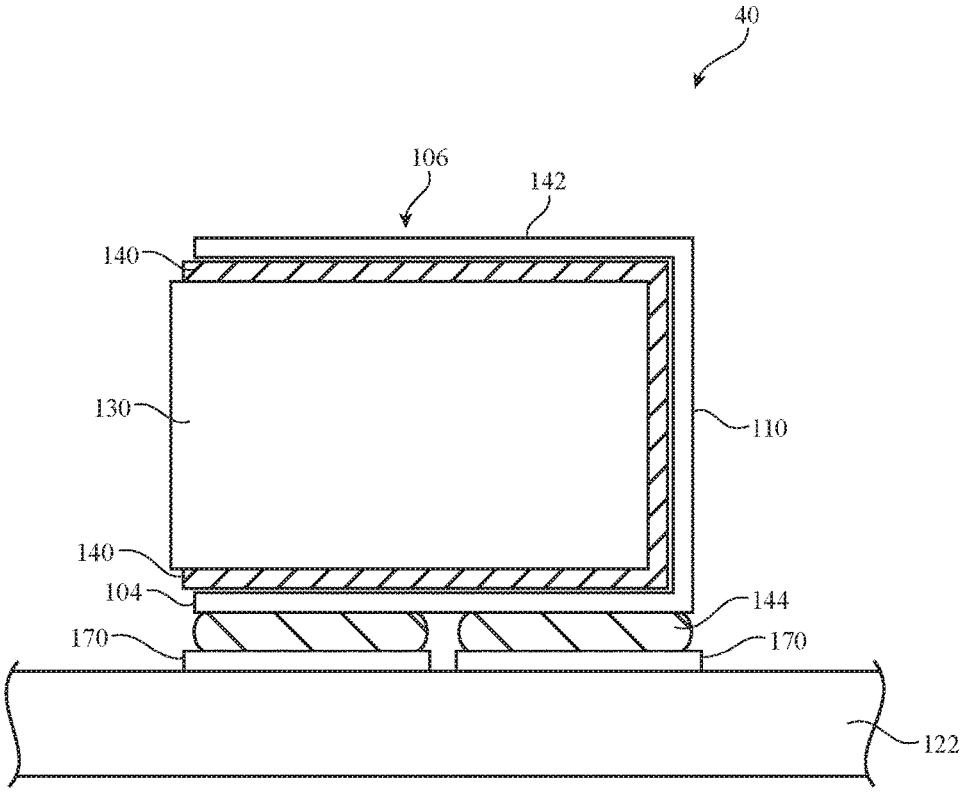
FIG. 6 is a cross-sectional side view of an illustrative antenna in accordance with an embodiment.

As shown in the cross-sectional side view of antenna 40 in FIG. 6, metal 142 may be attached to carrier 130 using adhesive 140. Adhesive 140 may be formed in one or more layers on some or all of the surfaces of carrier 130. Adhesive 140 may, for example, form a first layer that is interposed between the portion of metal 142 that forms resonating element 106 and a second layer that is interposed between the portion of metal 142 that forms ground 104 and carrier 130. Adhesive 140 may also be formed on the sides of carrier 130 to help mount metal 142 securely to carrier 130 (if desired). Adhesive 140 may be formed from a polymer that is cured at room temperature or at elevated temperatures (as examples). The presence of adhesive 140 helps ensure that the structures of antenna 40 such as metal 142 will not rattle when antenna 40 is exposed to vibrations during the use of speakers in device 10 to produce sound. Solder 144 may be used to solder ground 104 of antenna 40 to solder pads formed from ground traces 170 on printed circuit 122. Carrier 130 may be formed from a plastic that is compatible with soldering temperatures (e.g., carrier 130 may be formed from a material such as polyetheretherketone or other suitable plastic that withstands temperatures of at least 250° C. or at least 260° C. or other elevated temperatures when soldering the ground plane portion 104 to solder pads 170). Traces 170 may be coupled to ground traces on the underside of printed circuit 122 using one or more vias that pass through printed circuit 122.

Figure 7:
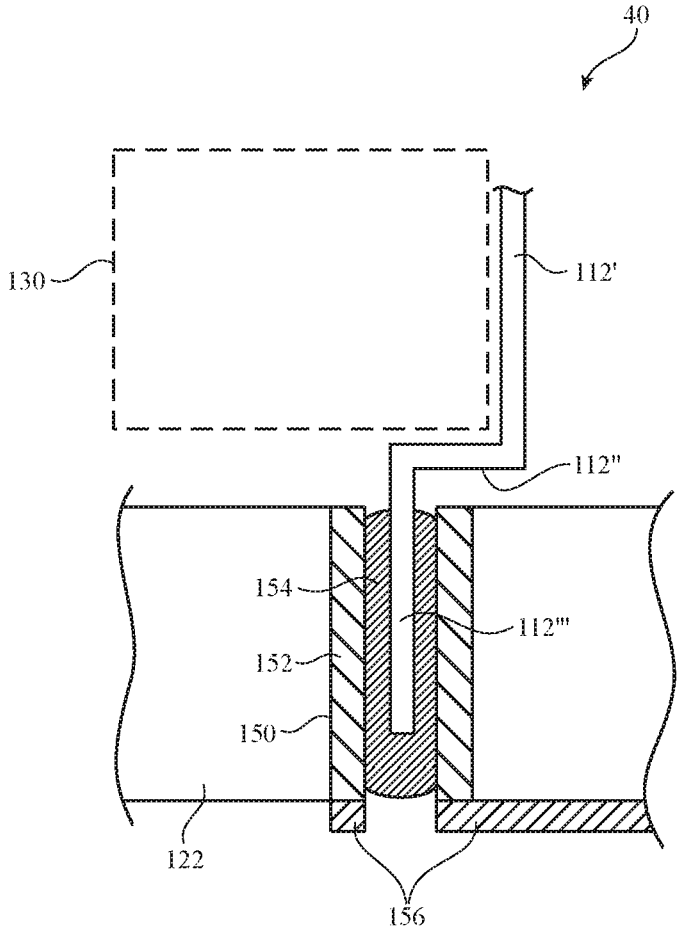
FIG. 7 is a cross-sectional side view of a portion of an antenna feed in accordance with an embodiment.

As shown in the cross-sectional view of antenna 40 of FIG. 7, feed path 112' may have a bent end portion such as bent end portion 112" that extends under the lower surface of carrier 130 (i.e., between the upper surface of printed circuit 122 and the lower surface of carrier 130 that faces the upper surface of printed circuit 122). Bent end portion 112"

extends under a surface of carrier 130 opposing the surface of carrier 130 that supports resonating element 106 and helps to secure metal 142 to carrier 130 and thereby prevent vibration of antenna 40. Portion 112''' of path 112' may extend into opening 150 of printed circuit 122. The inner surfaces of opening 150 may be coated with metal such as plated metal 152. Solder 154 may be used to secure portion 112''' within opening 150. Metal traces on the lower surface of printed circuit 122 such as traces 156 may form conductive path 94 in transmission line 92 and other circuit paths.

Figure 8:
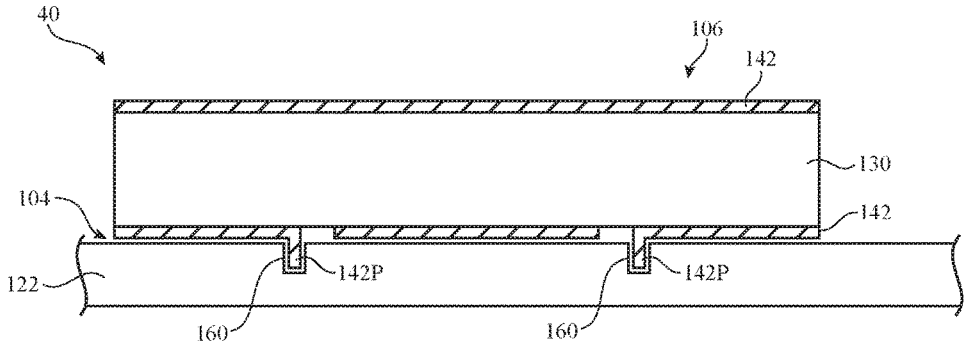
FIG. 8 is a cross-sectional side view of an illustrative antenna showing how the antenna may have alignment features such as metal prongs that mate with corresponding alignment features on a printed circuit board such as alignment holes in accordance with an embodiment.

As shown in the cross-sectional side view of antenna 40 of FIG. 8, metal 142 may have alignment features such as protruding portions 142P that mate with corresponding alignment features such as openings 160 in printed circuit 122. Protrusions 142P may be formed from bent metal portions of metal 142 (i.e., protrusions 142P may be metal prongs extending from the metal of antenna 40). Openings 160 may be free of metal or may be plated or otherwise coated with metal. Solder, adhesive, or other material may be placed in openings 160 to help secure prongs 142P and thereby secure antenna 40 to printed circuit 122. If desired, other types of mating alignment structures may be provided on antenna 40 and printed circuit 122. The use of protrusions on antenna 40 and mating recesses in printed circuit 122 that receive the protrusions is merely illustrative.

Figure 9:
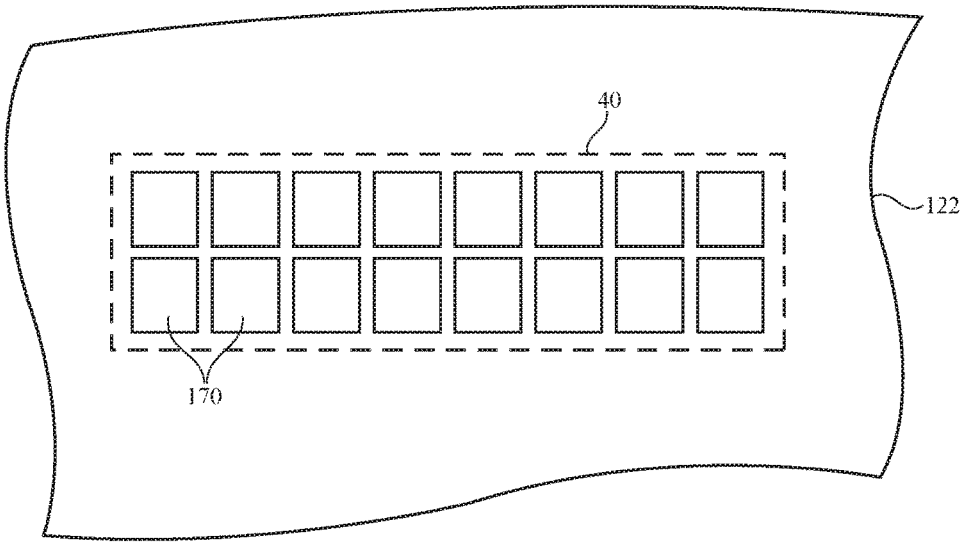
FIG. 9 is a top view of an illustrative set of printed circuit solder pads that may be used in mounting an antenna to a printed circuit in accordance with an embodiment.

If desired, printed circuit 122 may have an array of solder pads or other contacts for mating with ground portion 104 of metal 142. This type of arrangement is shown in the top view of FIG. 9. As shown in FIG. 9, printed circuit 122 may have an array of solder pads 170. There may be any suitable number of solder pads in the portion of printed circuit 122 to which antenna 40 is mounted (e.g., 5 or more, 10-30, more than 15, less than 40, etc.). The use of an array of multiple smaller pads rather than a single larger pad helps reduce the amount of heat transferred to printed circuit 122 during soldering, thereby avoiding potential overheating of printed circuit 122.

Figure 10:
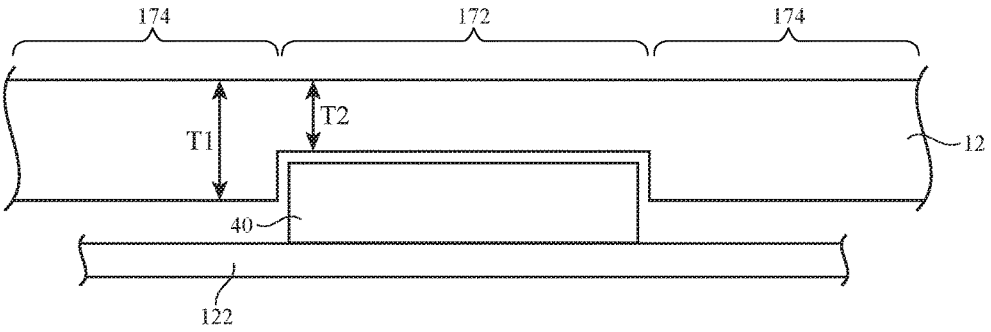
FIG. 10 is a cross-sectional side view of a portion of an illustrative electronic device housing wall having a locally thinned area that is aligned with an antenna in accordance with an embodiment.

To reduce signal losses as antenna signals pass through housing 12, housing 12 may have a locally thinned portion such as portion 172 of FIG. 10. The wall of housing 12 that is shown in FIG. 10 may, for example have a relatively large thickness T1 in regions 174 that do not overlap antenna 40 and may have a relatively thin thickness T2 in region 172 overlapping antenna 40. This allows antenna signals for antenna 40 to traverse less of the material of the housing wall (i.e., less of the plastic or other dielectric forming the housing wall), thereby improving wireless performance. Thickness T1 may be 0.1 mm to 3 mm, more than 0.5 mm, more than 1 mm, less than 4 mm, or other suitable thickness. Thickness T2 may be 0.1 to 0.4 mm, less than 5 mm, less than 3 mm, less than 2 mm, less than 1 mm, less than 0.5 mm, more than 0.2 mm, or other suitable thickness. If desired, an antenna window may be formed above antenna 40 (e.g., a logo-shaped plastic window inset into a surrounding metal housing wall or a dielectric antenna window of other suitable shapes, etc.). The configuration of FIG. 10 in which the housing wall for device 10 is formed from plastic or other dielectric with a locally thinned region aligned with antenna 40 is merely illustrative.

The foregoing is merely illustrative and various modifications can be made by those skilled in the art without departing from the scope and spirit of the described embodiments. The foregoing embodiments may be implemented individually or in any combination.

What is claimed is:

1. An electronic device having a front face and an opposing rear face, comprising:

a housing having first and second parallel metal speaker grills that respectively form the front and rear faces and a housing wall that extends between and is perpendicular to the first and second metal speaker grills;

an antenna mounted under the housing wall and interposed between the first and second metal speaker grills that transmits and receives antenna signals through the housing wall, wherein the antenna has a sheet metal layer that forms a planar inverted-F antenna resonating element, that forms a ground, that forms a return path that extends between the planar inverted-F antenna resonating element and the ground, and that forms a feed path extending from the planar inverted-F antenna resonating element; and a printed circuit to which the antenna is mounted, wherein the printed circuit has an opening, the feed path formed from the sheet metal layer passes at least partway through the opening, the antenna has an outer side facing outwardly towards the first metal speaker grill and an opposing inner side, and the antenna has a feed that includes the feed path and that is formed adjacent to the inner side.

2. The electronic device defined in claim 1 wherein the printed circuit has recesses that receive mating protruding portions of the sheet metal layer.

3. The electronic device defined in claim 1 wherein the printed circuit has an array of solder pads to which the ground is soldered.

4. The electronic device defined in claim 1 wherein the housing wall has a locally thinned portion that is aligned with the antenna.

5. The electronic device defined in claim 1 further comprising radio-frequency transceiver circuitry, wherein the printed circuit has an upper surface to which the antenna is mounted and has an opposing lower surface to which the radio-frequency transceiver circuitry is mounted.

6. The electronic device defined in claim 5 wherein the radio-frequency transceiver circuitry and the antenna are configured to transmit and receive radio-frequency signals at 2.4 GHz.

7. The electronic device defined in claim 6 wherein the radio-frequency transceiver circuitry and the antenna are further configured to transmit and receive radio-frequency signals at 5 GHz.

8. The electronic device defined in claim 1 further comprising a speaker mounted in the housing.

9. The electronic device defined in claim 1 wherein the antenna comprises a dielectric carrier.

10. The electronic device defined in claim 9 wherein the dielectric carrier has cavities separated by ribs and the feed path extends along one of the ribs.

11. The electronic device defined in claim 10 wherein the antenna includes at least one layer of adhesive between the sheet metal layer and the dielectric carrier.

12. A wireless speaker, comprising:

a housing;

a speaker mounted within the housing;

control circuitry coupled to the speaker;

radio-frequency transceiver circuitry coupled to the control circuitry;

a dielectric support structure having an upper wall, an opposing lower wall, a gap between the upper wall and the lower wall, and a plurality of ribs that extend across the gap from the upper wall to the lower wall to divide the gap into a plurality of air-filled cavities;

an antenna coupled to the radio-frequency transceiver circuitry that transmits and receives wireless signals, wherein the antenna has a sheet metal layer, the sheet metal layer has a first portion on the upper wall of the dielectric support structure configured to form an inverted-F antenna resonating element, and the sheet metal layer has a second portion that is configured to form a feed path, that is bent relative to the first portion, and that extends along and parallel to a selected rib of the plurality of ribs; and a printed circuit to which the antenna is mounted, wherein the printed circuit has recesses and the feed path extends into one of the recesses.

13. The wireless speaker defined in claim 12 wherein the sheet metal layer comprises stainless steel.

14. The wireless speaker defined in claim 12 wherein the sheet metal layer is soldered to an array of solder pads on the printed circuit.

15. The wireless speaker defined in claim 12 wherein the sheet metal layer is configured to form a ground plane portion that that is soldered to at least one solder pad on the printed circuit and a return path that is connected between the ground plane portion and the inverted-F antenna resonating element.

16. The wireless speaker defined in claim 12 wherein the radio-frequency transceiver circuitry and antenna are configured to operate at 2.4 GHz.

17. An antenna, comprising:

a plastic carrier having a plurality of air-filled cavities separated by ribs; and a sheet metal layer attached to the plastic carrier with at least one layer of adhesive, wherein the sheet metal layer is configured to form a planar inverted-F antenna resonating element, a ground plane portion, a return path that is connected between the ground plane portion and the inverted-F antenna resonating element, and a feed path that extends along an entire one of the ribs from the planar inverted-F antenna resonating element towards the ground plane portion.

18. The antenna defined in claim 17 further comprising a printed circuit having solder pads to which the ground plane portion is soldered, wherein the feed path has a portion that extends at least partly through an opening in the printed circuit and the plastic carrier is formed from a material that withstands temperatures of at least 250° C. when soldering the ground plane portion to the solder pads.

19. The antenna defined in claim 17, wherein the plastic carrier has an upper wall and an opposing lower wall and a gap formed between the upper wall and the lower wall and the ribs of the plastic carrier extend across the gap from the upper wall to the lower wall to divide the gap into the plurality of air-filled cavities.

20. The antenna defined in claim 19, wherein the feed path extends along and parallel to the entire one of the ribs from the upper wall of the plastic carrier to the opposing lower wall of the plastic carrier.

* * * * *